US005413543A

United States Patent [19]

Drago

[11] Patent Number: 5,413,543

[45] Date of Patent: May 9, 1995

[54] ANKLE, FOOT AND TOES EXERCISING APPARATUS

[76] Inventor: Marcello S. Drago, 17557 Rhoda St., Encino, Calif. 91316

[21] Appl. No.: 95,849

[22] Filed: Jul. 23, 1993

[51] Int. Cl.[6] ..... A63B 21/04; A63B 23/08; A63B 23/10

[52] U.S. Cl. ..... 482/49; 482/79; 482/123; 482/129

[58] Field of Search ..... 482/79-80, 482/121-130, 49-50

[56] References Cited

U.S. PATENT DOCUMENTS

| | | | |
|---|---|---|---|
| 980,634 | 1/1911 | Hazelton | 482/80 |
| 1,587,749 | 9/1926 | Bierly | 482/80 |
| 2,250,493 | 7/1941 | Milne | 482/79 |
| 3,295,847 | 1/1967 | Matt, Sr. | 482/80 |
| 3,929,329 | 12/1975 | Bivera | 482/79 X |
| 4,093,211 | 6/1978 | Horne et al. | 482/49 |
| 4,279,415 | 7/1981 | Katz | 482/80 |
| 4,577,861 | 3/1986 | Bangerter et al. | 482/79 |
| 4,611,805 | 9/1986 | Franklin et al. | 482/129 |
| 4,623,141 | 11/1986 | Salvino | 482/127 X |
| 4,635,932 | 1/1987 | Dewees | 482/79 |
| 4,669,722 | 6/1987 | Rangaswamy | 482/79 |
| 4,739,986 | 4/1988 | Kucharik et al. | 482/79 |
| 4,862,875 | 9/1989 | Heaton | 482/79 X |
| 5,176,598 | 1/1993 | Gardner | 482/79 |
| 5,178,596 | 1/1993 | McIntire | 482/122 |

FOREIGN PATENT DOCUMENTS

| | | | |
|---|---|---|---|
| 2248059 | 5/1975 | France | 482/79 |
| 791377 | 12/1980 | U.S.S.R. | 482/79 |

*Primary Examiner*—Richard J. Apley
*Assistant Examiner*—John Mulcahy
*Attorney, Agent, or Firm*—Albert O. Cota

[57] ABSTRACT

A portable exercising apparatus (10) that allows a person to exercise the ankle, foot and toes either individually or in a combination exercise. The apparatus (10) includes a lower stationary platform (12) that is attached to an upper movable platform (20) by a platform spring (22). When a foot is placed upon the upper platform (20), the ankle and feet are exercised by moving the upper platform up and down and/or in a radial motion. The apparatus (10) also includes a pressure and hand/forearm exercising strap assembly (30) that attaches to the left or right edges (20C,20D) of the upper platform. The assembly (30) allows pressure to be maintained on the foot when exercising and includes on its upper end a hand and forearm exerciser (40). The apparatus also has a foot holding strap (64) which allows the foot to be held in-place upon the upper surface of the upper movable platform (20).

5 Claims, 4 Drawing Sheets

ANKLE, FOOT AND TOES EXERCISING APPARATUS

TECHNICAL FIELD

The invention pertains to the general field of exercising devices and more particularly to a portable ankle, foot and toes exercising apparatus.

BACKGROUND ART

The field of body exercising is replete with various simple exercising devices and with complex exercising apparatuses. In general, the simple prior art devices are designed to exercise a certain part of the body such as the hand/forearm, neck, biceps, legs etc. The more complex exercisers are typically large, stationary apparatuses, that allow an individual, by changing or adjusting certain implements of the apparatus, to perform combination routines that exercise most all parts of the body. These combination exercisers are relatively expensive, heavy and large. Therefore, moving them from one location to another is not practical.

All of the prior art exercising devices and apparatuses, in one design or another, serve to exercise various parts of the body. However, none were disclosed that specifically allowed a person to exercise his or her toes in combination with complimentary exercising of the foot and ankle. The ability to exercise the toes is especially important for the relief of sore feet that can occur after a day of walking, running or just sitting with the feet planted on a floor.

A search of the prior art did not disclose any patents that read directly on the claims of the instant invention. However, the following U.S. patents were considered related:

| U.S. Pat. No. | INVENTOR | ISSUED |
|---|---|---|
| 5,069,445 | Mai | 3 December 1991 |
| 4,573,678 | Lamb, et al | 4 March 1986 |
| 4,279,415 | Katz | 21 July 1981 |

The Mai U.S. Pat. No. 5,069,445 discloses a foot-leg exercise device that includes two foot supporting platforms that each are connected to and swing about a base structure. Each platform has a spring attached that provides resistance against a downward deflection of the platform by a person's foot. The resistive force of each spring can be adjusted to suit the requirements of an individual by a manual screw adjustment. The device may also includes a hand-grip cross bar to which a user grasps while performing the exercise routine.

The Lamb et al U.S. Pat. No. 4,573,678 discloses a lower extremity muscle conditioner device consisting of an adjustable foot gear that is strapped to a user's foot. The foot gear includes a base having an angularly adjustable sole platform connected by a heel pivot to the base. The platform has an associated manual adjustment mechanism for raising the toe end of the platform to any selected degree above the heel end. This adjustment allows the foot to dorsiflex upon walking so that the lower extremity muscles are stretched and conditioned.

The Katz U.S. Pat. No. 4,279,415 discloses a treadle type exercise device which simulates a jogging condition. The device consists of at least two pedals pivotally mounted to one end of each platform member and spaced at the other end from the platform member by springs. The space between the inclined pedals and platform member is substantially filled with a cushable, energy-absorbent, resilient material. This material functions to provide a cushioned resistance when foot pressure is applied to the platforms.

For background purposes and as indicative of the art to which the invention relates, reference may be made to the following remaining patents found in the search:

| U.S. Pat. No. | INVENTOR | ISSUED |
|---|---|---|
| 5,178,596 | McIntire | 12 January 1993 |
| 4,159,111 | Lowth | 26 June 1979 |

DISCLOSURE OF THE INVENTION

The ankle, foot and toes exercising apparatus is designed to provide a portable apparatus that is sized so that it can be conveniently used at various locations such as a home or office. The apparatus is designed to exercise one foot at a time. However, two apparatuses can be placed side-by-side and used simultaneously when the exerciser is seated.

The inventive exercising apparatus consists of a rectangular, lower stationary platform that is attached to a smaller dimensioned upper movable platform. The attachment of the two platforms is made by a platform spring that is slightly offset longitudinally to the rear and that serves as the pivot arm for the two platforms. The upper movable platform includes on its upper surface, a non-slip pad or an acupressure pad and further includes a foot holding strap assembly and a toe exercising assembly.

The foot holding strap has one of its sides attached to one side of the upper movable platform. The strap is placed around the ankle of the foot and then attached to the other side of the platform by means of a hook and loop fastener. The attached strap allows the foot to be steadied on the platform during an exercise routine. The toe exercising assembly consists of a toe gripping rod that includes a pair of compression springs. The springs are attached at a 45-degree angle to the upper front edge of the upper movable platform.

To perform the exercise routines on the ankle, foot and toes exercising apparatus, a person places his or her foot on the upper platform and attaches the foot strap. The ankle and foot may then be exercised by moving the upper movable platform up and down, radially or in a combination exercise that includes both the up and down and radial motions. The toes are exercised by placing them over the toe gripping rod. The toes are then moved up and down, inward and outward or in a combination exercise that includes both the up and down and the inward and outward motions. The exercising of the toes has been found to not only relieve stress, but also to improve blood circulation and relieve cramps. When the toes are exercised or massaged in combination with the application of acupressure on the sole of the foot, the benefit of the exercise is strongly enhanced.

To further enhance the utility of the invention, a pressure and hand/forearm exercising strap assembly is included. This assembly consist of a tension strap that can be detachably attached to either side of the lower stationary platform. This assembly has two functions: firstly, during an exercise, it allows the foot placed on the upper movable platform to be steadied and the foot pressure applied to be regulated; secondly, it includes on its upper end a hand and forearm exerciser that when squeezed produces a resistance that is felt by both the hand and forearm.

In view of the above disclosure, it is the primary object of the invention to provide a portable, self-contained apparatus that allows an individual to exercise the ankle, foot and toes either individually or in a combination exercise.

In addition to the primary object of the invention, it is also an object of the invention to provide an ankle, foot and toes exercising apparatus that:

is relatively maintenance free, is cost effective from both a manufacturer and consumer point of view, and can be used in combination with a second apparatus to allow both right and left sections of the body to be exercised.

BEST MODE FOR CARRYING OUT THE INVENTION

Figure 1:
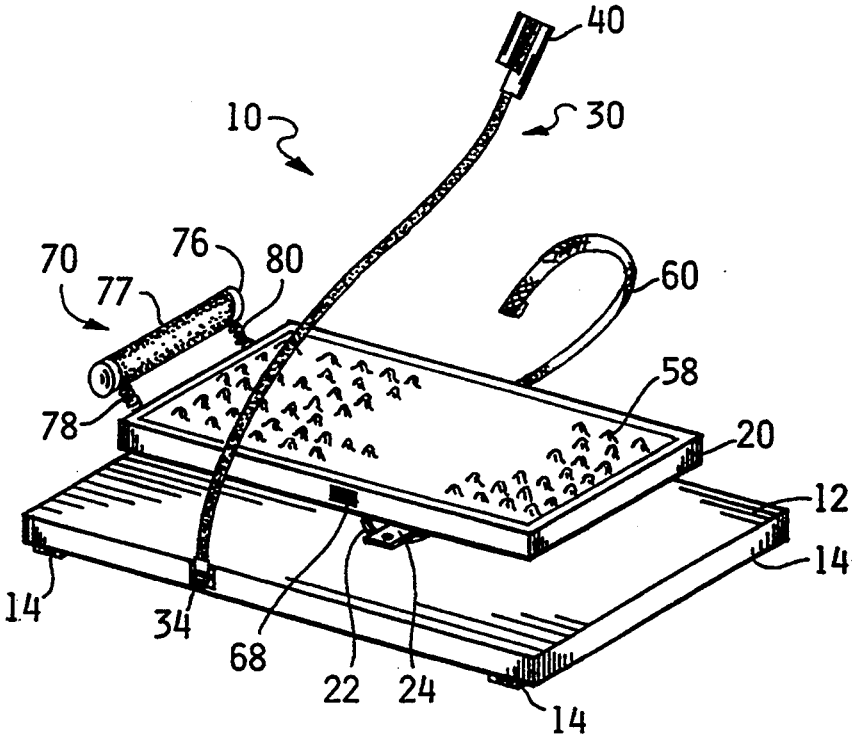
FIG. 1 is a perspective view of the overall ankle, foot and toes exercising apparatus that includes an acupressure pad attached to the upper movable platform.

The best mode for carrying out the invention is presented in terms of a preferred embodiment for a portable, convenient and easy to use exercising apparatus 10. The apparatus is primarily designed to exercise the ankle, foot and toes and designed to exercise the hand and forearm. The preferred embodiment as shown in FIGS. 1–12 is comprised of the following major elements: a lower stationary platform 12, an upper movable platform 20, a platform spring 22, a pressure and hand exercising strap assembly 30, a hand and forearm exerciser 40, a foot holding strap assembly 60 and a toe exercising assembly 70.

Figure 2:
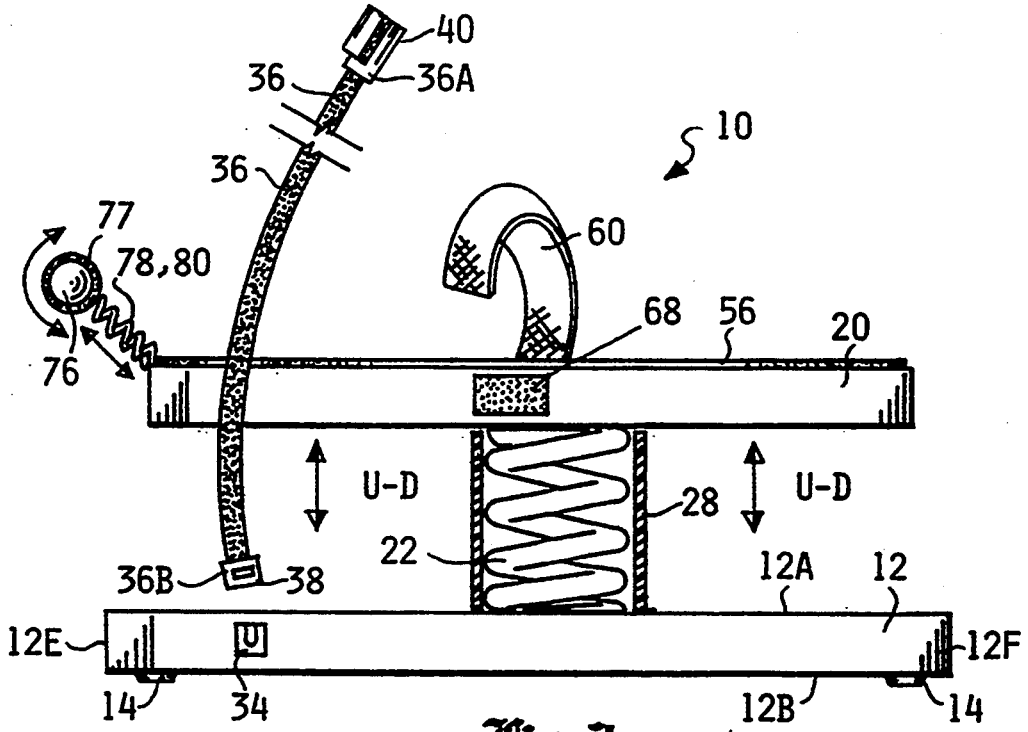
FIG. 2 is a side elevational view of the overall apparatus that includes a non-slip pad attached to the upper movable platform and a sectional view of a platform spring boot.
Figure 3:
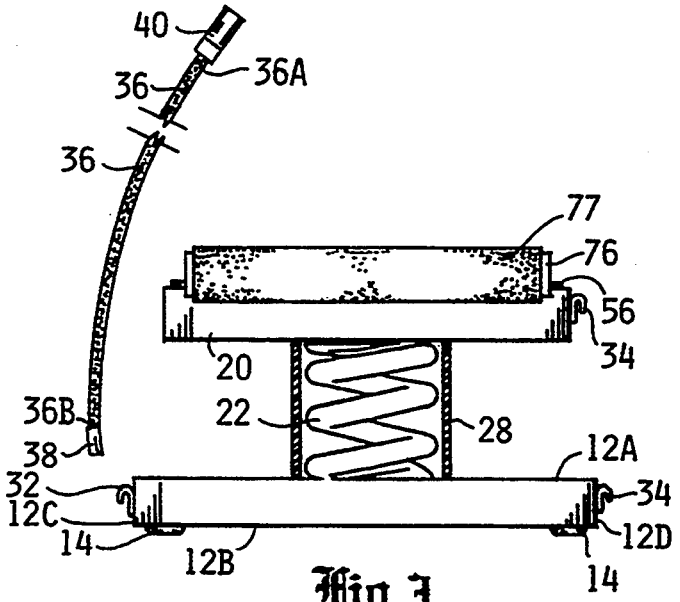
FIG. 3 is a front elevational view of the overall apparatus as shown in FIG. 2.
Figure 4:
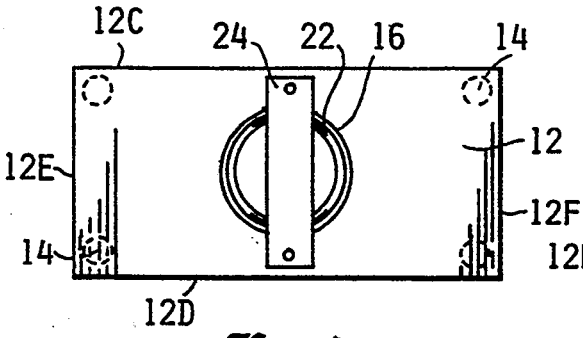
FIG. 4 is a top plan view of the lower stationary platform showing the platform spring inserted into a spring cavity and attached by means of a spring anchor plate.
Figure 5:
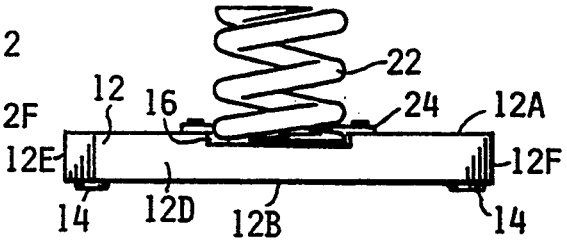
FIG. 5 is a side elevational view of the lower stationary platform as shown in FIG. 4.

The overall ankle foot and toes exerciser apparatus is shown in perspective in FIG. 1, and in a side elevational and front view in FIGS. 2 and 3 respectively. The lower stationary platform 12 as also shown in FIGS. 4 and 5, may be constructed of metal, plastic or wood and preferably is in a rectangular shape that has an upper surface 12A, a lower surface 12B, a left edge 120, a right edge 12D, a front edge 12E and a back edge 12F. Attached to its lower surface 12B at each corner, is a resilient foot 14.

Figure 6:
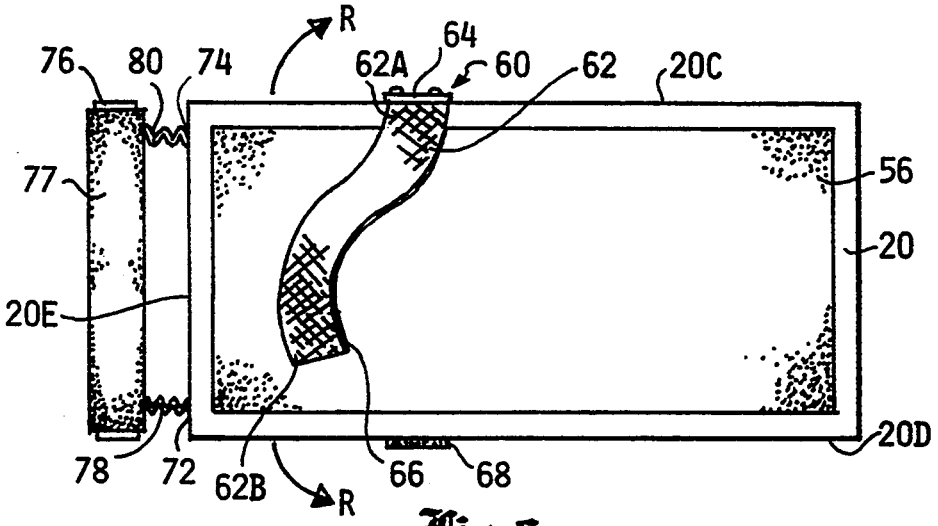
FIG. 6 is a top plan view of upper movable platform showing the attachment of the toe exercising assembly and the foot holding strap assembly.
Figure 7:
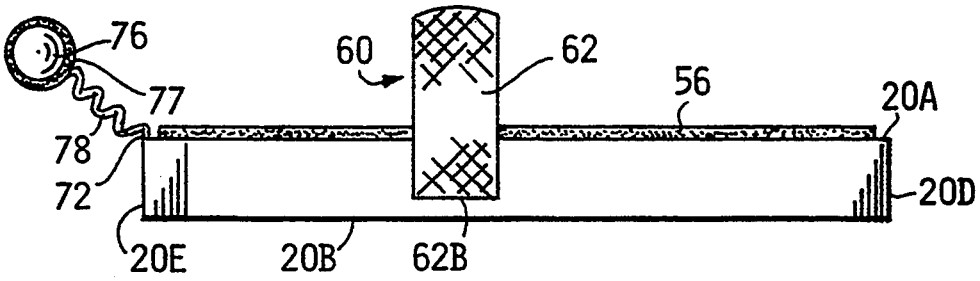
FIG. 7 is a side elevational view of the upper movable platform detached from the lower stationary platform and with the assemblies as shown in FIG. 6.

The upper movable platform 20 as shown in FIGS. 6 and 7, may also be constructed of metal, plastic or wood and is in a rectangular shape but is dimensioned to form a smaller rectangle than that of the lower stationary platform 12 to allow the stationary platform 12 to function as a stable platform for the apparatus 10. The upper platform 20 includes an upper surface 20A, a lower surface 20B, a left edge 200, a right edge 20D and a front edge 20E. Over the upper surface 20A of the upper platform, is attached either a non-slip pad 56 as shown in FIGS. 6 and 7 or an acupressure pad 58 as shown in FIG. 1. The acupressure pad has an attachment means such as hook and loop fasteners, that allow the pad to be selectively attached and detached.

The upper movable platform 20 is movably attached to the lower stationary platform 12 by means of a platform spring 22 as best shown in FIGS. 2 and 3. The spring 22 is attached by an attachment means that preferably consists of a spring anchor plate 24 that is placed across the bottom and upper rungs of the platform spring as shown best in FIG. 4. Alternatively, a spring cavity 16 may be cut into the lower and upper surfaces 20B, 12A of the upper and lower platform 20, 12. This cavity is sized to receive the diameter of the respective end of the platform spring 22. Over each cavity is then placed and bolted a spring anchor plate 24 as shown in FIGS. 4 and 5. The spring is preferably made of steel, and is sized to optimize the pivoting action and to provide an exerciser with sufficient resistance when the upper movable platform 20 is moved by the person exercising. Over the circumference of the platform spring 22 is preferably placed a resilient spring boot 28 as shown in FIGS. 2 and 3.

To allow the foot placed on the upper movable platform 20 to remain held in-place, a foot holding strap assembly 60 is utilized as best shown in FIGS. 6 and 7. The assembly consists of a hook section 68, of a hook and loop fastener, and a holding strap 62. The hook section 68 is substantially centered and attached to the right edge 20D of the upper movable platform 20. The foot holding strap 62 has a first end 62A that is rigidly attached, by an attachment means 64, such as screws, to the left edge 200 of the upper movable platform 20 in substantial alignment with the hook section 68. The second end 62B of the strap 62 has attached a loop section 66, of a hook and loop fastener. When the strap 62 is placed over the foot and the loop section 66 is attached to the hook section 68, the foot is held in place.

To further control the pressure that is placed by the foot upon the upper movable platform 20 and to provide additional stabilization, the pressure and hand-/forearm exercising strap assembly 30 as shown in FIGS. 1, 2 and 3, is utilized. This assembly 30 consists of a first male clip 32 swivelly attached to the left edge 120 of the lower stationary platform 12 and a second male clip 34 also swivelly attached to the right edge 12D of the assembly 12. The pressure strap 36 which is constructed of a resilient material, has an upper end 36a and a lower end 36B. To the lower end 36B is attached a female clip 38 that is removably attached to either the first or second male clip 32,34. One strap assembly 30 is generally required, which can be placed in either of the male clips, depending on whether a person is right handed or left handed. However, if desired two such strap assemblies can be attached to and in performing an exercise. To the upper end 36A of the pressure and hand/forearm exercising assembly 30 is attached a hand and forearm exerciser 40 which is disclosed in two designs.

Figure 8:
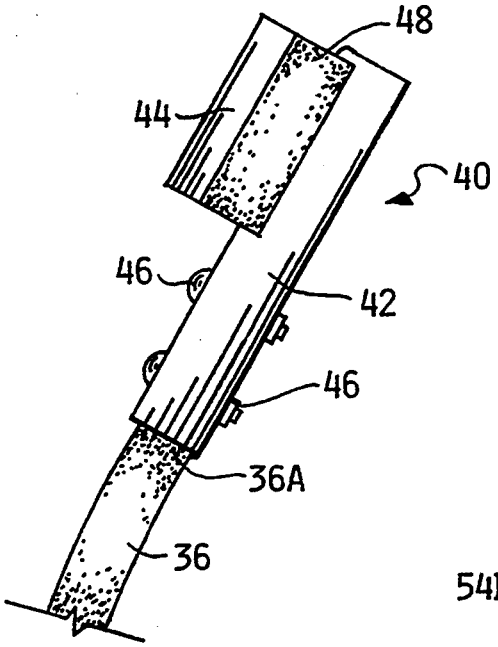
FIG. 8 is a fragmented elevational view of a first design for a hand and forearm exerciser attached to a pressure strap.
Figure 9:
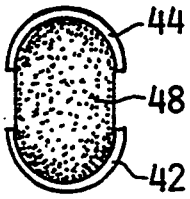
FIG. 9 is an end view of the hand and forearm exerciser shown in FIG. 8.

The first design of the hand and forearm exerciser 40 as best shown in FIGS. 8 and 9 consists of a stationary grip 42 a movable grip 44 and a resilient section 48. The grip 42 is attached to the upper end 36A of the strap 36 by an attachment means such as a pair of bolts 46 as shown in FIG. 8. Between the inwardly movable grip 44 is attached the resilient section 48 which preferably consists of a foam rubber. When the stationary and movable grips are squeezed together by the hand, a resistance is provided that exercises the hand and forearm.

Figure 10:
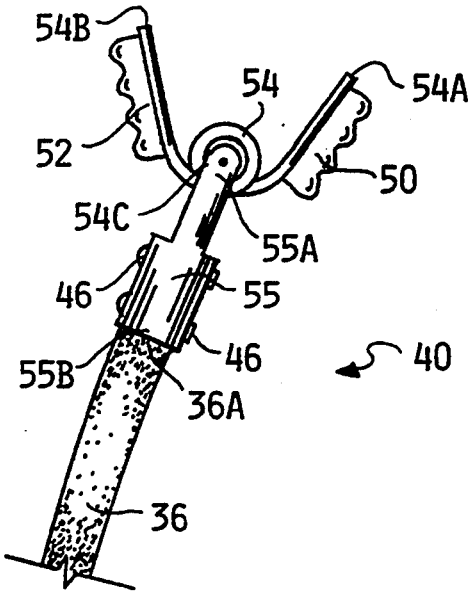
FIG. 10 is a fragmented elevational view of a second design for a hand and forearm exerciser attached to a pressure strap.

The second design of the hand a forearm exerciser 40 is shown in FIG. 10. This design consists of a first hand grip 50 and a second hand grip 52 that are attached between a first arm 54A and a second arm 54B respectively of a torsion spring 54. At the center of the spring 54 is an opening 54C which serves as an attachment point for the front end 55A of a strap attachment sleeve 55. The sleeve 55 also has a back end 55B which attaches to the upper end 36A of the pressure straps 36 by an attachment means such as a pair of bolts 46.

The final element which comprises the ankle, foot and toes apparatus 10 is the toe exercising assembly 70 which is also disclosed in two designs.

The first design of the assembly 70 is shown in FIGS. 1, 6 and 7. To enable the assembly 70, the upper movable platform 20 has spaced apart at its front edge 20E, a first spring bore 72 and a second spring bore 74 that are bored at a substantially 45-degree angle. This design also includes a toe gripping rod 76 that has at best shown in FIGS. 6 and 7, a first spring 78 and a second spring 80. The two springs are attached and spaced across the rod 76 to allow the springs to be aligned for insertion into and attached respectively to the base of the first and second spring bores 72, 74. To add comfort and for hygenic purposes, a gripping rod cover 77 is employed that wraps around the rod 76. The cover has means for allowing it to be removed for washing or replacement.

Figure 12:
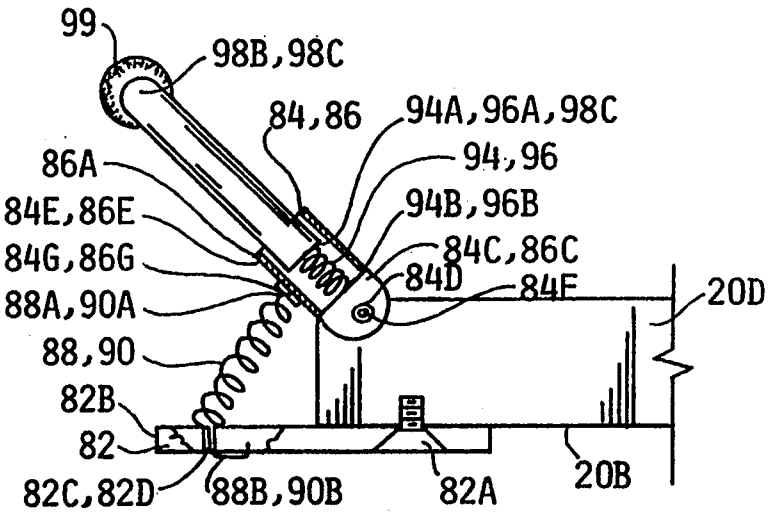
FIG. 12 is a side elevational view of the toe exercising assembly shown in FIG. 11.
Figure 11:
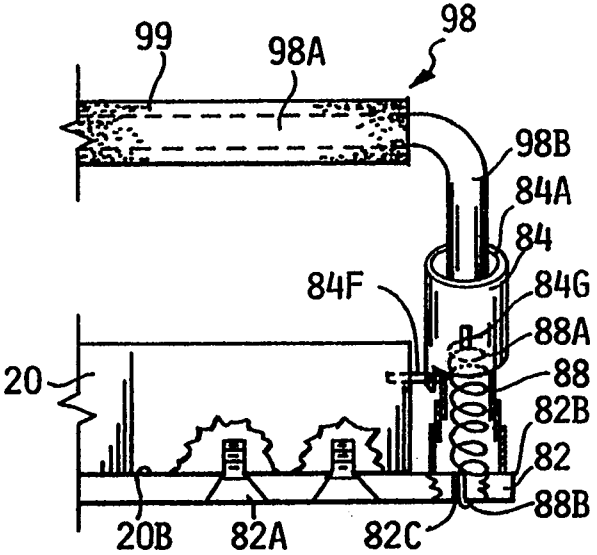
FIG. 11 is a front elevational view of a second design for a toe exercising assembly.

The second design of the assembly 20 is shown in FIGS. 11 and 12. This assembly consists of a spring anchor plate 82, a first spring sleeve 84, a second spring sleeve 86, a first plate compression spring 88, a second plate compression spring 90, a first sleeve compression spring 94 and a second sleeve compression spring 96.

The spring anchor plate 82 is rigidly attached to the lower surface 20B of the upper movable platform 20 by means of bolts 82A. The front section 82B of the plate, which extends forward of the front end 20E of platform 20, has therethrough and spaced apart, a first spring anchor bore 820 and a second spring anchor bore 82D. The first and second spring sleeves 84,86 have a front end 84A,86A, a back section 84C,86C that includes a bore 84D,86D, and a bottom surface 84E,86E. Into the bores 84D,86D is inserted a pin 84F,86F that allows the sleeves to be swivelly attached to the left edge 20C and right edge 20D near the front edge 20E of the upper movable platform 20. The sleeves also include on their bottom surfaces 84E,86E, a first spring attachment loop 84G and an second spring attachment loop 86G.

The first and second plate compression springs 88,90 have a top end 88A,90A and a bottom end 88B,90B. The top ends of the springs are attached to the first spring attachment loop 84G and second spring attachment loop 86G located respectively on the first and second spring sleeves 84,86. The bottom end 88B,90B are then attached to the first and second spring anchor bores 82C,82D on the spring anchor plate 82. Each of the springs 88,90 is preferable inserted into a substantially rigid, collapsible spring boot 92 as best shown in FIG. 10. This boot aids in maintaining a vertical up and down movement and reinforces the swivel attachment of the first and second spring sleeves 84,90.

The first and second sleeve compression springs 94,96 as shown in FIG. 12, have a top end 94A,96A and a bottom end 94B,96B. The first and second springs 94,96 are inserted into the first and second spring sleeves 84,86 respectively with the bottom ends 94B,96B rigidly attached to the back section 84C,86C of the first and second spring sleeves 84,86.

The final element of this toe exercising assembly 70 is the toe gripping rod 98. This rod, has a horizontal section 98A and integrally attached a first vertical section 98B and a second vertical section 98C. The ends of the first and second vertical sections are rigidly attached, by an attachment means 98C, to the respective top ends of the first and second sleeve compression springs 94,96. To complete this assembly, a detachable resilient cover 99 is placed around the horizontal section 98A of the toe gripping bar as shown in FIGS. 11 and 12.

Operation

To operate the ankle, foot and toes exercising apparatus 10, either one or two apparatuses 10 may be employed. If one is used, a person may either stand or sit to perform an exercise sequence. However, if two apparatuses are used, one for each foot, it is advisable that the exercising sequence be performed with the person seated. In either case, a person places his or her foot upon the upper movable platform 20. The foot holding 62 strap is then placed around the foot and attached to allow the foot to remain firmly placed on the platform 20.

The ankle and foot may be exercised by allowing the foot to move the upper movable platform 20 about the platform spring 22 in an up and down direction U-D as shown by the arrows in FIG. 2, or radially R as shown by the arrows in FIG. 6. If desired, a combination exercise consisting of both an up and down motion and a radial motion can also be performed.

To exercise the toes, the toes are placed over the toe gripping rod 76 or 98. The toes are then moved up and down, inward or outward or in combination exercise consisting of both an up and down motion and an inward and outward motion.

The apparatus also allows the hand and forearm to be exercised. To perform this exercise, either individually or in combination with the ankle, foot and toes, the strap 36 of the pressure and hand/forearm exercising strap assembly 30 is attached as previously described and as shown in FIGS. 2 and 3. The hand and forearm exerciser 40 of either design are squeezed together by the hand. This squeezing action produces a resistance that is felt by the hand and forearm.

While the invention has been described in complete detail and pictorially shown in the accompanying drawings, it is not to be limited to such details, since many changes and modifications may be made in the invention without departing from the spirit and scope thereof. For example, the apparatus can be utilized as only a toe exercising apparatus that consists of a lower stationary platform 12 and a toe exercising assembly 70. In this design configuration (not shown), the platform 12 has spaced apart on its front edge 12E, a first spring bore 72 and a second spring bore 74 that are located at a substantially 45-degree angle. The toe gripping assembly 70 includes a toe gripping rod 76 having attached across the rod, a first spring 78 and a second spring 80. The two springs are sized and spaced to allow them to be inserted into and attached respectively to the base of the first and second spring bores 72,74. To use the toe exercising apparatus, the foot is placed on the platform 12 with the toes placed over the toe gripping rod 76. The toes are then exercised by moving them up and down, inward and outward or in a combination exercise consisting of both an up and down motion and an inward and outward motion. Hence, the invention is described to cover any and all modifications and forms which may come within the language and scope of the appended claims.

I claim:

1. An ankle, foot and toes exercising apparatus comprising:

a) a lower stationary platform having an upper surface, a lower surface, a left edge, a right edge, a front edge and a back edge, b) an upper movable platform having an upper surface, a lower surface, a left edge, a right edge and a front edge, c) a platform spring attached between said lower stationary platform and said upper movable platform by an attachment means, where when a foot is placed upon said upper movable platform, the ankle and foot can be exercised by allowing the foot to move said upper movable platform, about said platform spring, up or down, radially or in a combination exercise comprising both an up and down motion and a radial motion, and d) a toe exercising assembly comprising:

(1) said upper movable platform having spaced apart at its front edge, a first spring bore and a second spring bore, where said bores are bored at a substantially 45-degree angle, and (2) a toe gripping rod having a first spring and a second spring attached and spaced across said gripping rod to allow said first and second springs to be inserted into and attached respectively to the base of said first and second spring bores, where said toe exercising assembly allows said toes to be moved up and down, inward and outward or in a combination exercise comprising both an up and down motion and an inward and outward motion.

2. An ankle, foot and toes exercising apparatus comprising:

a) a lower stationary platform having an upper surface, a lower surface, a left edge, a right edge, a front edge and a back edge, b) an upper movable platform having an upper surface, a lower surface, a left edge, a right edge and a front edge, c) a platform spring attached between said lower stationary platform and said upper movable platform by an attachment means, where when a foot is placed upon said upper movable platform, the ankle and foot can be exercised by allowing the foot to move said upper movable platform, about said platform spring, up or down, radially or in a combination exercise comprising both an up and down motion and a radial motion, and d) a toe exercising assembly comprising:

(1) said upper movable platform having spaced apart at its front edge, a first spring bore and a second spring bore, where said bores are bored at a substantially 45-degree angle, (2) a toe gripping rod having a first spring and a second spring attached and spaced across said gripping rod to allow said first and second springs to be inserted into and attached respectively to the base of said first and second spring bores, and (3) a gripping rod cover that wraps around said toe gripping rod, said cover having means for allowing it to be removed for washing or replacement where said toe exercising assembly allow said toes to be moved up and down, inward and outward or in a combination exercise comprising both an up and down motion and an inward and outward motion.

3. An ankle, foot and toes exercising apparatus comprising:

a) a lower stationary platform having an upper surface, a lower surface, a left edge, a right edge, a front edge and a back edge, b) an upper movable platform having an upper surface, a lower surface, a left edge, a right edge and a front edge, c) a platform spring attached between said lower stationary platform and said upper movable platform by an attachment means, where when a foot is placed upon said upper movable platform, the ankle and foot can be exercised by allowing the foot to move said upper movable platform, about said platform spring, up or down, radially or in a combination exercise comprising both an up and down motion and a radial motion, and d) a toe exercising assembly comprising:

(1) a spring anchor plate rigidly attached to the lower surface of said upper movable platform, with the front section of said plate extending forward of the front edge on said upper movable platform, with the front section of said plate having therethrough and spaced apart, a first spring anchor bore and a second spring anchor bore, (2) a first spring sleeve having a front end, a back section and a bottom surface, where the back section is swivelly attached to the left edge and near the front edge of said upper movable platform, said spring sleeve further having a first spring attachment loop located at its bottom surface near its front end, (3) a second spring sleeve having a front end, a back section and a bottom surface, where the back section is swivelly attached to the right edge and near the front edge of said upper movable platform, said spring sleeve further having a second spring attachment loop located at its bottom surface near its front end, (4) a first plate compression spring having a top end and a bottom end, where the top end is attached to the first spring attachment loop on said first spring sleeve and the bottom end is attached to the first spring anchor bore on said spring anchor plate, (5) a second plate compression spring having a top end and a bottom end where the top end is attached to the second spring attachment loop on said spring sleeve and the bottom end is attached to the second spring anchor bore on said spring anchor plate, (6) a first sleeve compression spring having a top end and a bottom end, where said first sleeve compression spring is inserted into said first spring sleeve and its bottom end is attached to the back section of said first spring sleeve, (7) a second sleeve compression spring having an top end and a bottom end, where said second sleeve spring is inserted into said second spring sleeve and its bottom end is attached to the back section of said second spring sleeve, and (8) a toe gripping rod having a horizontal section and integrally, a first vertical section and a second vertical section, where the ends of the first and second vertical sections are rigidly attached, by an attachment means, to the respective top ends of said first and second sleeve compression springs where said toe exercising assembly allows said toes to be moved up and down, inward and outward or in a combination exercise comprising both an up and down motion and an inward and outward motion.

4. An ankle, foot and toes exercising apparatus comprising:

a) a lower stationary platform having an upper surface, a lower surface, a left edge, a right edge, a front edge and a back edge, b) an upper movable platform having an upper surface, a lower surface, a left edge, a right edge and a front edge, c) a platform spring attached between said lower stationary platform and said upper movable platform by an attachment means, where when a foot is placed upon said upper movable platform, the ankle and foot can be exercised by allowing the foot to move said upper movable platform, about said platform spring, up or down, radially or in a combination exercise comprising both an up and down motion and a radial motion, and d) a toe exercising assembly comprising:

(1) a spring anchor plate rigidly attached to the lower surface of said upper movable platform, with the front section of said plate extending forward of the front edge on said upper movable platform, with the front section of said plate having therethrough and spaced apart, a first spring anchor bore and a second spring anchor bore, (2) a first spring sleeve having a front end, a back section and a bottom surface, where the back section is swivelly attached to the left edge and near the front edge of said upper movable platform, said spring sleeve further having a first spring attachment loop located at its bottom surface near its front end, (3) a second spring sleeve having a front end, a back section and a bottom surface, where the back section is swivelly attached to the right edge and near the front edge of said upper movable platform, said spring sleeve further having a second spring attachment loop located at its bottom surface near its front end, (4) a first plate compression spring having a top end and a bottom end, where the top end is attached to the first spring attachment loop on said first spring sleeve and the bottom end is attached to the first spring anchor bore on said spring anchor plate, (5) a second plate compression spring having a top end and a bottom end where the top end is attached to the second spring attachment loop on said spring sleeve and the bottom end is attached to the second spring anchor bore on said spring anchor plate, (6) a substantially rigid, collapsible spring boot placed around the circumference of said first and second plate compression springs, (7) a first sleeve compression spring having a top end and a bottom end, where said first sleeve compression spring is inserted into said first spring sleeve and its bottom end is attached to the back section of said first spring sleeve, (8) a second sleeve compression spring having an top end and a bottom end, where said second sleeve spring is inserted into said second spring sleeve and its bottom end is attached to the back section of said second spring sleeve, and (9) a toe gripping rod having a horizontal section and integrally, a first vertical section and a second vertical section, where the ends of the first and second vertical sections are rigidly attached, by an attachment means, to the respective top ends of said first and second sleeve compression springs, where said toe exercising assembly allows said toes to be moved up and down, inward and outward or in a combination exercise comprising both an up and down motion and an inward and outward motion.

5. An ankle, foot and toes exercising apparatus comprising:

a) a lower stationary platform having an upper surface, a lower surface, a left edge, a right edge, a front edge and a back edge, b) an upper movable platform having an upper surface, a lower surface, a left edge, a right edge and a front edge, c) a platform spring attached between said lower stationary platform and said upper movable platform by an attachment means, where when a foot is placed upon said upper movable platform, the ankle and foot can be exercised by allowing the foot to move said upper movable platform, about said platform spring, up or down, radially or in a combination exercise comprising both an up and down motion and a radial motion, d) a pressure and hand-exercising strap assembly comprising:

(1) a first male clip swivelly attached to the left edge of said lower stationary platform, (2) a second male clip swivelly attached to the right edge of said lower stationary platform, (3) a pressure strap constructed of a resilient material and having an upper end and a lower end, where to the lower is attached a female clip that is removably attached to either said first or second male clip and to its upper end is attached a hand and forearm exerciser, e) a foot holding strap comprising:

(1) a hook section of a hook and loop fastener substantially centered and attached to the right edge of said upper movable platform, (2) a foot holding strap having a first end rigidly attached to the left edge of said upper movable platform in substantial alignment with said hook section and a second end having attached a loop section of a hook and loop fastener, where when said strap is place over the foot and the second end is attached to said hook section, the foot is held in-place upon the upper surface of said upper movable platform, and f) a toe exercising assembly comprising:

(1) said upper movable platform having spaced apart at its front edge, a first spring bore and a second spring bore, where said bores are bored at a substantially 45-degree angle, and (2) a toe gripping rod having a first spring and a second spring attached and spaced across said gripping rod to allow said first and second springs to be inserted into and attached thereto respectively to the base of said first and second spring bores, where when the toes are placed over said toe gripping rod, the toes can be exercised by moving them up and down, inward and outward or in a combination exercise comprising both an up and down and on inward and outward motion.

* * * * *